United States Patent [19]

Takahashi et al.

[11] 4,039,355

[45] Aug. 2, 1977

[54] ALUMINUM ALLOY SHAPES

[75] Inventors: Toshiro Takahashi; Toshihiro Nagano; Kenji Wada, all of Shizuoka; Masaru Kikuchi, Fuji, all of Japan

[73] Assignee: Riken Light Metal Industries Company, Ltd., Japan

[21] Appl. No.: 550,223

[22] Filed: Feb. 18, 1975

[30] Foreign Application Priority Data

Mar. 29, 1974 Japan ..... 49-35421

[51] Int. Cl.[2] ..... C22C 21/08

[52] U.S. Cl. ..... 148/31.5; 75/147; 148/2; 148/12.7 A; 148/20.6; 148/32.5; 148/159

[58] Field of Search ..... 148/2, 3, 13.1, 12.7, 148/20.6, 32.5, 159, 31.5, 12.7 A; 75/141, 142, 146, 147

[56] References Cited

U.S. PATENT DOCUMENTS

| | | | |
|---|---|---|---|
| 3,032,448 | 5/1962 | Siebel et al. | 148/12.7 |
| 3,234,054 | 2/1966 | Sperry | 148/12.7 |
| 3,642,542 | 2/1972 | Sperry et al. | 148/12.7 |
| 3,899,370 | 8/1975 | Takahashi et al. | 148/159 |

*Primary Examiner*—R. Dean

*Attorney, Agent, or Firm*—McNenny, Pearne, Gordon, Gail, Dickinson & Schiller

[57] ABSTRACT

An aluminum alloy consising essentially of 0.65 to 0.75% by weight of magnesium and 0.50 to 0.60% by weight of silicon or 0.47 to 0.57% by weight of magnesium and 0.75 to 0.85% by weight of silicon, 0.15% to 0.25% by weight of iron, less than 0.05% of an impurity selected from the group consisting of copper, manganese, zinc, chromium, and titanium and the balance aluminum, the aluminum alloy being subjected to aging treatment at a temperature below 200° C for 20 to 50 minutes to obtain 0.2% proof stress larger than 11 kg/mm², ultimate tensile strength larger than 20 kg/mm² and elongation more than 8%. Aluminum alloy shapes are formed of the above aluminum alloy by extrusion forming of the aluminum alloy to obtain an extrusion, coating a film on the surface of the extrusion with a water-soluble paint after forming thereon a ground film, heating the extrusion at a temperature below 200° C for 20 to 50 minutes to effect printing and hardening of the coated film and age hardening of the extrusion at the same time.

2 Claims, 10 Drawing Figures

ALUMINUM ALLOY SHAPES

BACKGROUND OF THE INVENTION

1. Field of the Invention

This invention relates to aluminum alloy shapes and a method of making the same, and more particularly to aluminium alloy shapes whose aging is ensured to properly proceed by achieving heat treatment at a temperature below 200° C for a short period of time and a method of making such aluminum alloy shapes.

2. Description of the Prior Art

An age hardening aluminum alloy has recently been developed, whose mechanical properties compare favorably with those of steel or like materials and which is light-weight, highly anti-corrosive and small in deformation resistance. Accordingly, it is used for various purposes, in particular, widely used for construction materials. Those aluminum alloy shapes now used for construction materials are placed on the market after coated with paint.

A conventional method of making aluminum alloy shapes is as follows.

As illustrated in FIG. 1, the manufacture starts with homogenization treatment of a cast ingot of aluminum alloy, for example, at 550° C for 2 to 3 hours. The cast ingot is then pre-heated, for example, at 400° to 500° C for 5 to 10 minutes and formed by extrusion in a predetermined shape.

Next, the extruded shapes of the predetermined shape thus obtained are heated at 205° C ± 5° C for 60 minutes to cause aging to proceed. Thereafter, the extruded shapes are subjected to ground film forming, coating, coated film printing and hardening and like treatments to provide aluminum alloy shapes.

In the conventional manufacturing method, however, substantially no consideration is paid to economy of energy and simplification of the manufacturing processes, so that there are many problems to be solved. To overcome such problems, the present inventors devised such a method as shown in FIG. 2 in which the extruded shapes are immediately subjected to the ground film forming and coating treatments without artificially expediting aging of the aluminum alloy and then heat-treated to thereby effect printing and hardening of the coated film and, also, age hardening.

With this manufacturing method, the ground film forming, coating and other treatments are achieved before age hardening of the aluminum alloy, so that these treatments can be easily performed and all the processes from extrusion forming to coating can be designed on a continuous system. Further, since aging is artificially caused to proceed simultaneously with the coated film printing and hardening process, heat treatment for artificial aging can be saved, which accomplishes an economy of energy and, also, ensures close contact of the coated film with the shapes.

However, the manufacturing method shown in FIG. 2 makes it necessary that the condition for aging of the aluminum alloy and that for coated film printing and hardening are substantially coincident with each other. It is very difficult to satisfy this requirement on an industrial scale.

Namely, an aluminum alloy commercially known under the name of A.A6063 is most widely used for construction materials. This aluminum alloy is a typical age hardening alloy and a highly excellent alloy such that when it is in the state of a cast ingot, a required extrusion property is satisfied by homogenization treatment and preheat treatment and that aging is artificially caused to proceed by subsequent heating to provide mechanical characteristics. Further, this alloy is defined to contain 0.52% of magnesium and 0.45% of silicon, and the alloy now on the market contains such materials exactly or substantially in the defined amounts. In the case of this alloy, the extrusion property is not impaired and when it is heat-treated at 205° C ± 5° C for 60 minutes, aging properly proceeds to provide predetermined mechanical properties. However, if the conditions for aging are altered, that is, if the time for aging is shortened and if the aging temperature is lowered, the predetermined mechanical properties can not be obtained.

Accordingly, in the case where the coated film printing and hardening condition and the artificial aging condition are made coincident with each other in this alloy on the market, if no special paint is used, it is required to lower the heating temperature and unnecessarily lengthen the heat treatment time so as not to deteriorate properties of the coated film. However, this brings about unfavorable results.

On the other hand, it is considered possible that if a special paint fit with the aging conditions of the alloy on the market is employed, the coated film printing and hardening and the age hardening of the alloy are achieved at the same time. However, it is technically difficult to raise only the printing and hardening temperature, for example, up to 205° C ± 5° C without impairing the water solubility of the paint which is the most suitable for dip coating. Even if this problem is technically solved, the special paint contains an expensive composition, and hence is very costly.

Further, considering the aging conditions of the alloy on the market from the viewpoint of energy, the aging temperature of 205° C ± 5° C is too high and it is desired to lower the temperature and the aging time of 60 minutes is also too long and it is preferred to shorten this time.

SUMMARY OF THE INVENTION

This invention is to provide a composition of an aluminum alloy which enables sufficient aging of the alloy only by heating it at a temperature below 200° C (exclusive of 200° C) for 20 to 50 minutes, a method of making aluminum alloy shapes by subjecting the aluminum alloy of such composition to casting, extrusion forming and surface treatment and the aluminum alloy shapes thus produced.

Other objects, features and advantages of this invention will become apparent from the following description taken in conjunction with the accompanying drawings.

DESCRIPTION OF THE PREFERRED EMBODIMENTS

Figure 1:
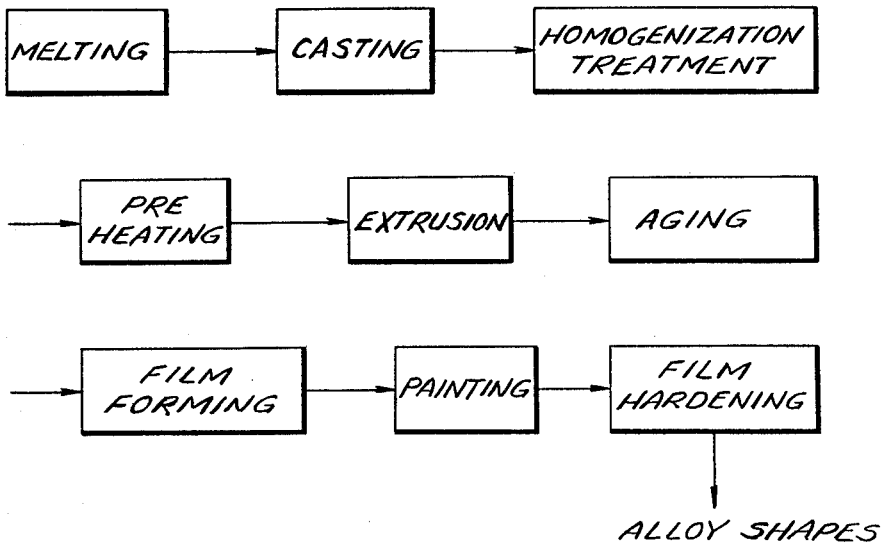
FIG. 1 is a flow chart of a conventional method of making aluminum alloy shapes.

A description will be given first with regard to the composition of the aluminum alloy according to this invention.

A. On aging conditions

The most important factor of the present invention is the aging conditions and it is of prime importance that required mechanical properties are obtained with the aging conditions. Namely, in the alloy A.A6063 which is now widely used for construction materials, aging proceeds when it is heated at 205° C ± 5° C for 60 minutes and optimimum mechanical properties are thus obtained. However, in the case where aging is caused to proceed simultaneously with hardening of a coated film of an inexpensive water soluble paint and the heating time for age hardening is remarkedly shortened as in the present invention, it is necessary that aging of the alloy properly proceeds under such aging conditions as a temperature lower than 200° C (exclusive of 200° C) and a period of time in the range of 20 to 50 minutes.

B. On mechanical properties

In the present invention, mechanical properties, which are equal to or more excellent than those of aluminum alloys on the market, are obtained with the aging conditions mentioned in (A). Accordingly, the mechanical strength of the alloy A.A6063 (0.2% proof stress 11 kg/mm$^2$, ultimate tensile strength 15 kg/mm$^2$elongation 8%) which is regarded as proper, is aimed at. In particular, 0.2% proof stress of 15 kg/mm$^2$, ultimate tensile strength of 20 kg/mm$^2$ and elongation of 8% are aimed values, which are obtainable with the alloy of this invention having the following composition.

C. On magnesium

Magnesium forms an intermetallic compound such as $Mg_2Si$ with silicon and they are deposited in the form of $Mg_2Si$ with a decrease in the solubility of magnesium. With an increase in the amount of $Mg_2Si$ deposited, mechanical strength is enhanced and $Mg_2Si$ is deposited through a process of an acicular phase (G.P. Zone) — a bar-shaped phase - a plate-shaped phase. However, in the case of excessive aging occurs in this process, $Mg_2Si$ is separated in the plate-shaped phase, whose mechanical strength is deteriorated as compared with that of the acicular or bar-shaped phase.

To avoid this, the present inventors studied the range of amount of each of magnesium and silicon in which aging would be properly achieved under the aging conditions referred to in (A) and $Mg_2Si$ would be appropriately deposited in the acicular or bar-shaped phase and, as a result of their study, it has been found that when silicon is in the range of 0.50 to 0.60%, a proper range of magnesium is 0.65 to 0.75% and that when silicon is in the range of 0.75 to 0.85%, the proper range of magnesium is 0.47 to 0.57%.

Namely, even if $Mg_1Si$ is deposited in the plate-shaped phase, its deposited amount is not directly related to enhancement of the mechanical strength. Accordingly, only by increasing the amount of $Mg_2Si$ connecting the amount of magnesium with that of silicon, the mechanical strength cannot be enhanced. Further, an increase in the amount of $Mg_2Si$ leads to deterioration of the extrusion property, and hence is not desirable. Therefore, in the present invention, considering that the amount of silicon is small when it is in the range of 0.50 to 0.60%, such a relatively large amount of magnesium as 0.65 to 0.75% is added, by which even if aging treatment is effected under the conditions mentioned in (A), $Mg_2Si$ of acicular or bar-shaped phase is properly separated. So long as magnesium is in the above range, if it is changed so that the atomic ratio of magnesium to silicon may be substantially 2:1, the amount of $Mg_2Si$ is changed and the mode of its deposition is held appropriately, by which mechanical strength can be enhanced. With magnesium less than 0.65%, required strength cannot be obtained and, with magnesium exceeding 0.75%, the extrusion property poses a problem.

Further, in the case of silicon being in the range of 0.75% to 0.85%, as will be described later, excess silicon promotes aging to some extent and the deposition of silicon itself provides for enhanced mechanical strength, so that even if the amount of magnesium is relatively small, mechanical strength can be improved to provide hardness which is higher than that of the alloy of the above composition, that is, substantially the highest. However, when magnesium is less than 0.47%, the age hardening property is rapidly deteriorated. Further, when magnesium is more than 0.57%, if excess silicon is assumed to be present, a problem arises in the extrusion property, too, and the aging promoting effect by silicon is lost.

D. On silicon

Silicon forms the intermetallic compound such as $Mg_2Si$ with magnesium and, at the same time, excess silicon expedites aging. For example, even under such aging conditions as a temperature below 200° C and a time of 20 to 50 minutes, age hardening is properly promoted by silicon. Therefore, silicon is indispensable to this invention. Further, silicon less impairs the extrusion property than magnesium and it might be said preferable to increase the amount of silicon added than that of magnesium.

Accordingly, from the viewpoint of contribution to the formation of $Mg_2Si$, it is necessary to excessively add silicon as compared with magnesium. However, too large an amount of silicon impairs the extrusion property and it is therefore necessary to determine the correlation between magnesium and silicon in the point of the amount of excess silicon, too. Namely, in the case where magnesium is in the range of 0.65 to 0.75%, the amount of silicon in the range of 0.50 to 0.60% is excessive only from the viewpoint of the formation of $Mg_2Si$. As a result of our study of the relationship between the excess silicon and the phase of $Mg_2Si$, it has been found that where the excess silicon is about 0.09% or more, aging is properly promoted under the aforesaid aging conditions to provide the mechanical properties referred to above in (C). Thus, the lower limit of the amount of silicon is determined to be 0.50% as described above. On the other hand, the excess silicon promotes aging but too large an amount of magnesium also deteriorates the extrusion property, so that the upper limit of the amount of excess silicon is determined to be 0.60% in relation to the lower limit of that of magnesium.

Further, where the amount of magnesium is in the range of 0.47 to 0.57%, the amount of magnesium is smaller than that in the case of the amount of magnesium being in the range of 0.65 to 0.75% and is rather close to that contained in the alloy on the market but the amount of silicon is very excessive. Accordingly, in this case, since the amount of magnesium is small, even if an excessive amount of silicon is contained, the rate of deterioration of the extrusion property is low, as compared with the case where the amount of magnesium is large. Therefore, in the case of magnesium in the range of 0.47 to 0.57%, the amount of silicon can be increased to some extent but too large an amount of silicon results in deterioration of the extrusion property, so that the upper limit of the amount of silicon is determined to be 0.85%. Further, since the amount of magnesium is small, the amount of silicon can be made excessive by adding a small amount of silicon and the mechanical strength can be enhanced to some extent by the effect of adding silicon. However, the amount of $Mg_2Si$ separated is small and the mechanical strength is deteriorated, so that, in view of this, the lower limit of the amount of silicon is determined to be 0.50%.

In the foregoing, the amounts of magnesium and silicon are related to each other and it is preferred that the amounts of magnesium and silicon are 0.70% and 0.55% or close to them or 0.52% and 0.80% or close to them respectively. In these alloys, required mechanical strength can be obtained at the lowest temperature in a short time and the close contact property of the coated film is also enhanced.

E. On iron

Iron is generally called an impurity element and forms AlFeSi, $Fe_3SiAl_2$, $Fe_2Si_2Al_9$, etc. with aluminum and silicon. These ternary compounds are deposited in the form of relatively large particles in the matrix. Accordingly, a large amount of iron added deteriorates the mechanical strength of an alloy, and hence is not desirable. However, ternary compounds of some composition appropriately rough the surface of an aluminum alloy shape and are favorable for the formation of a ground film and the close contact property of a coated film. Therefore, the amount of iron is preferred to be in the range of 0.15 to 0.25%.

F. On copper, manganese, zinc, chromium, titanium, etc.

These elements are mixed in refining and other processes and it is desirable that the amounts of them mixed are as small as possible, preferably less than 0.05%.

Figure 2:
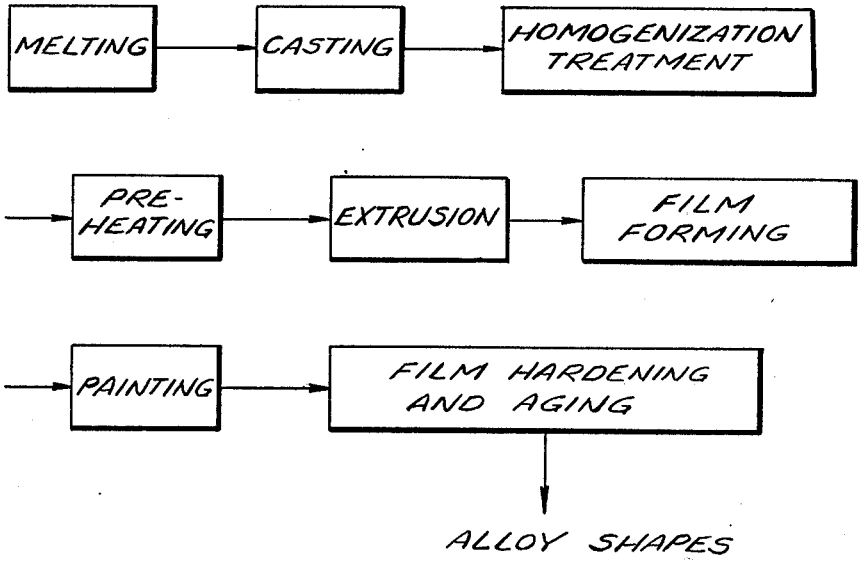
FIG. 2 is a flow chart of a method of making aluminum alloy shapes according to this invention.

The aluminum alloy of this invention has such a composition as described in the foregoing and, by achieving aging at a temperature below 200° C for 20 to 50 minutes, required mechanical strength can be obtained. In the case of shapes of this alloy, the aging treatment and the coated film printing and hardening treatment can be effected simultaneously, as shown in FIG. 2, and even if the coated film is of an easily available water soluble paint, it does not become yellowish.

Namely, a cast billet of the aluminum alloy of this invention having the aforesaid composition is subjected to homogenization treatment and preheat treatment under usual conditions and then formed by extrusion, for example, at an extrusion speed of 26 m/min., after which the resulting aluminium alloy shape is subjected to correcting, ground film forming and coating processes. For the coating purpose, a water soluble thermal setting paint is satisfactory and, in usual cases, the paint for this purpose may be, for example, of acrylic system. After the coating process, the aluminium alloy material is heated at a temperature lower than 200° C for 20 to 50 minutes, by which the coated film is printed and hardened and, at the same time, aging is properly effected, thus providing an aluminum alloy shape having the mechanical properties mentioned previously in (B).

In the above example, the aluminum alloy shape formed of the alloy of the aforementioned composition is not subjected to the aging process immediately after extrusion forming but, instead, subjected to the coated film printing and hardening process and the aging process at the same time. This is because of the fact that omission of the aging process indispensable to the conventional method is preferred from the viewpoints of economy of energy and the close contact property of the coated film. Accordingly, the alloy of the aforesaid composition can also be treated by the conventional method. In such a case, extrusion forming is immediately followed by the aging process but the aging conditions in this case are sufficient to be a temperature below 200° C and a time of 20 to 50 minutes. Even under such conditions, the mechanical properties referred to above in (B) can be obtained and, further, since the aging time is shortened and the aging temperature is lowered, an economy of energy can be accomplished correspondingly.

Further, as described previously, when the aging process is achieved simultaneously with the coated film printing and hardening process after the surface treatment, a series of processes for extrusion forming, pretreatments such as degreasing, rinsing, etc. ground film forming, coating and heat treatment for aging and coated film printing and hardening can be designed as a continuous flow system. Moreover, in the case of simultaneously effecting age hardening and coated film printing and hardening, the aluminum alloy shape is likely to be deflected when it is suspended horizontally, as in the prior act, during such respective treatments as mentioned above and in the final heat treatment, since the aluminum alloy has not yet had the predetermined mechanical strength. This can be completely avoided by suspending the aluminum alloy shape vertically during such treatments. Further, by subjecting the aluminum alloy shape to all of the aforesaid processes while suspending it vertically, the processes can be easily automated and variations in the coated film can also be reduced.

Examples of this invention will hereinafter be described.

EXAMPLE 1

Billets of two kinds of aluminum alloys *a* and *b* (the aluminum alloy *a* contained 0.70% of Mg, 0.55% of Si, 0.20% of Fe other invisible impurities and Al and the aluminum alloy *b* contained 0.52% of Mg, 0.80% of Si, 0.20% of Fe, other invisible impurities and Al) were subjected to homogenization treatment at 550° C for 3 hours and preheated at 450° C for 10 minutes and then the respective aluminium alloy shapes were formed by extrusion at an extrusion speed of 24 m/min.

Thereafter, the respective aluminum alloy shapes were soaked in a 6% NaOH aqueous solution (60° C) for 30 seconds for degreasing and rinsed with water, thereafter being soaked in a 10% $HNO_3$ aqueous solution (room temperature) for neutralization.

Next, the aluminum alloy shapes were each anodized in a 15% sulfuric acid aqueous solution to form an aluminum oxide film 7 to 8μ thick as a ground film.

Following this, the aluminum alloy shapes were each dipped in an acrylic water soluble paint (containing 13.3% of acrylic resin, 6.1% of melanine resin, 22.1% of IPA, 3.4% of Ethylene Glycol Monoethyl Ether and 55.1% of water and others) for coating a film. Then, the aluminum alloy shapes were each heat-treated while changing the heating time at heating temperatures 180° C, 190° C and 200° C, respectively, to harden the film and, at the same time, achieve aging of the alloys. The relationship of the aging time to the 0.2% proof stress in this example were such as shown in FIG. 3.

Figure 3:
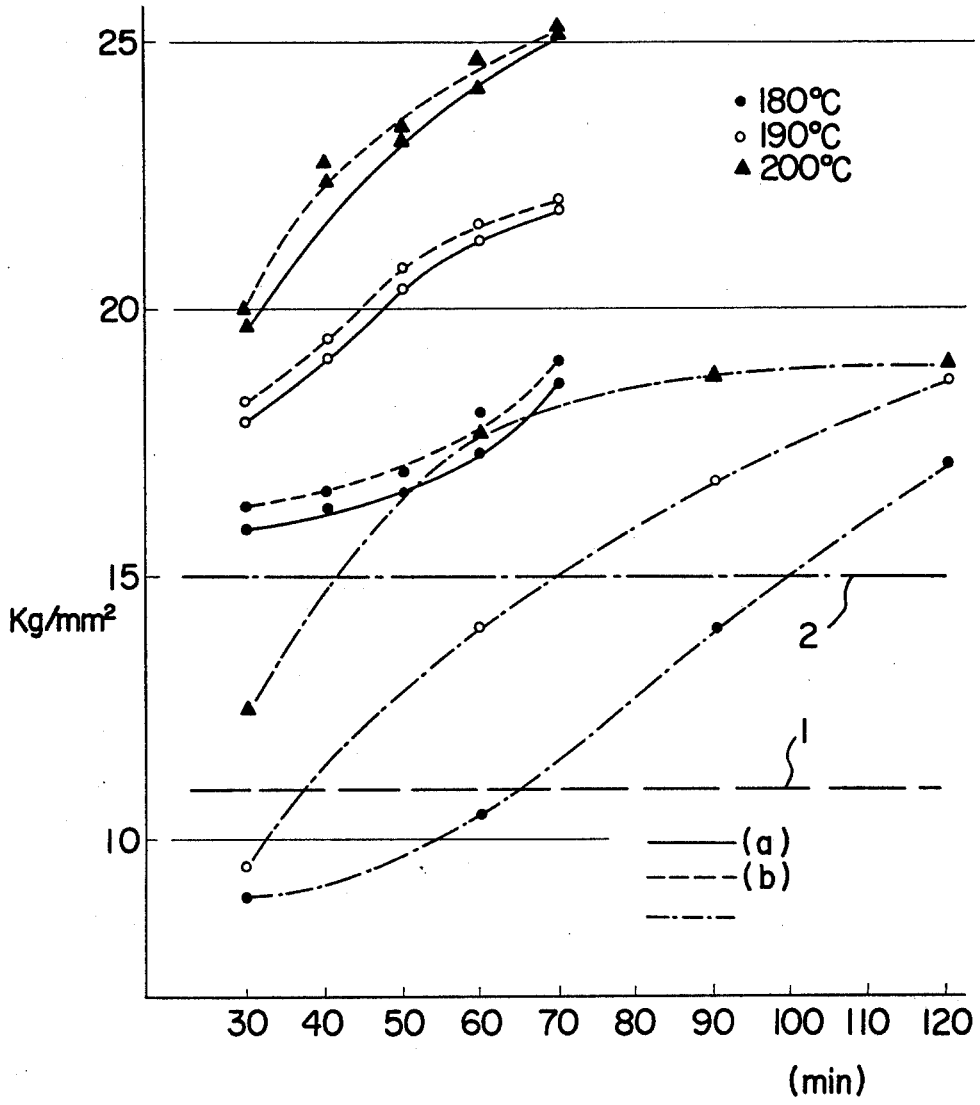
FIGS. 3 to 6, inclusive, are graphs showing mechanical properties of one example of aluminum alloy shapes of this invention and one example of conventional aluminum alloy shapes for comparison therewith.

In FIG. 3, solid lines indicate the alloy *a,* dotted lines indicate the alloy (*b*) and broken lines indicate the alloy A.A6063 on the market produced under the same conditions as mentioned above.

Figure 4:
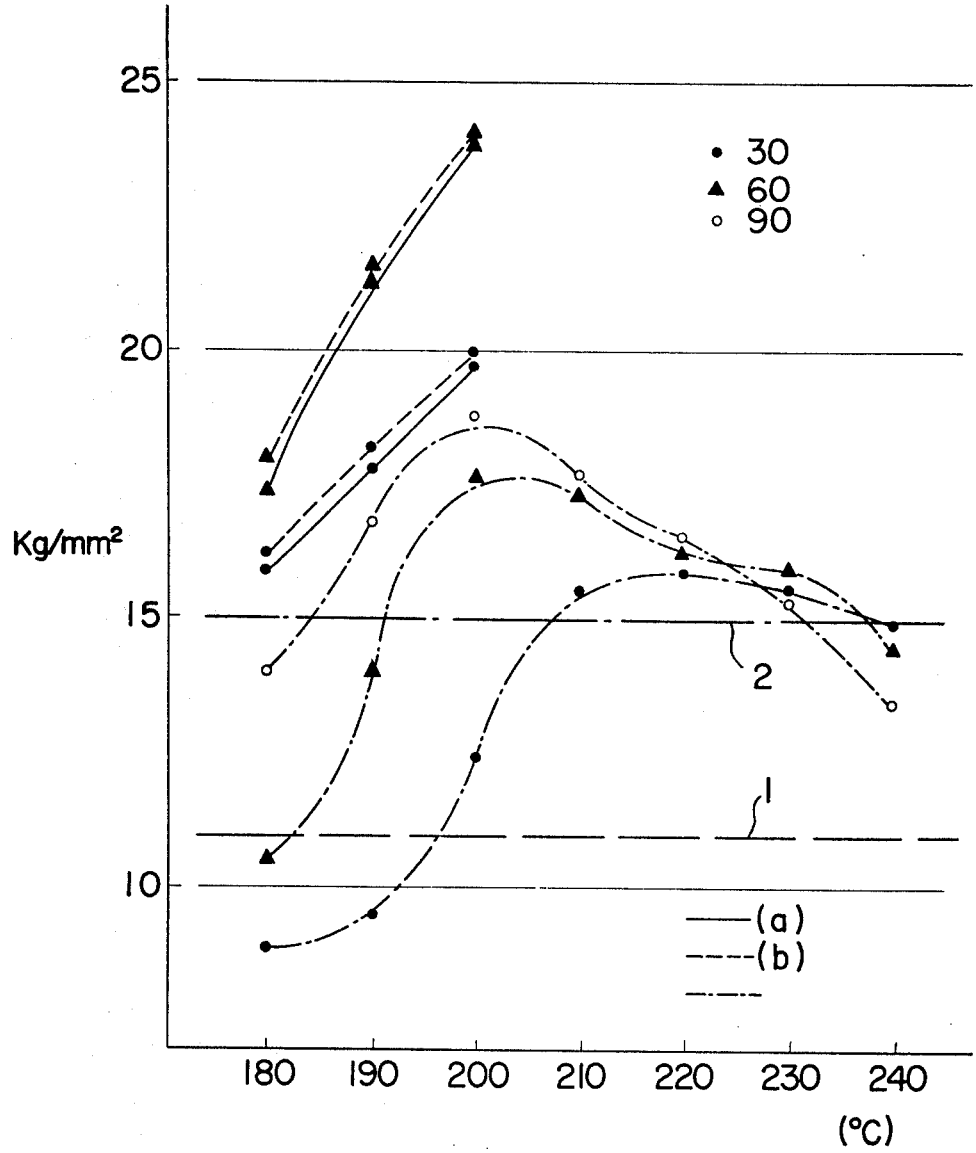

The relationships of the aging temperature to the 0.2% proof stress in the alloy *a,* the alloy *b* and the alloy A.A6063 on the market are such as shown in FIG. 4, in which the alloys are indicated by the same lines as in FIG. 3, respectively.

Figure 5:
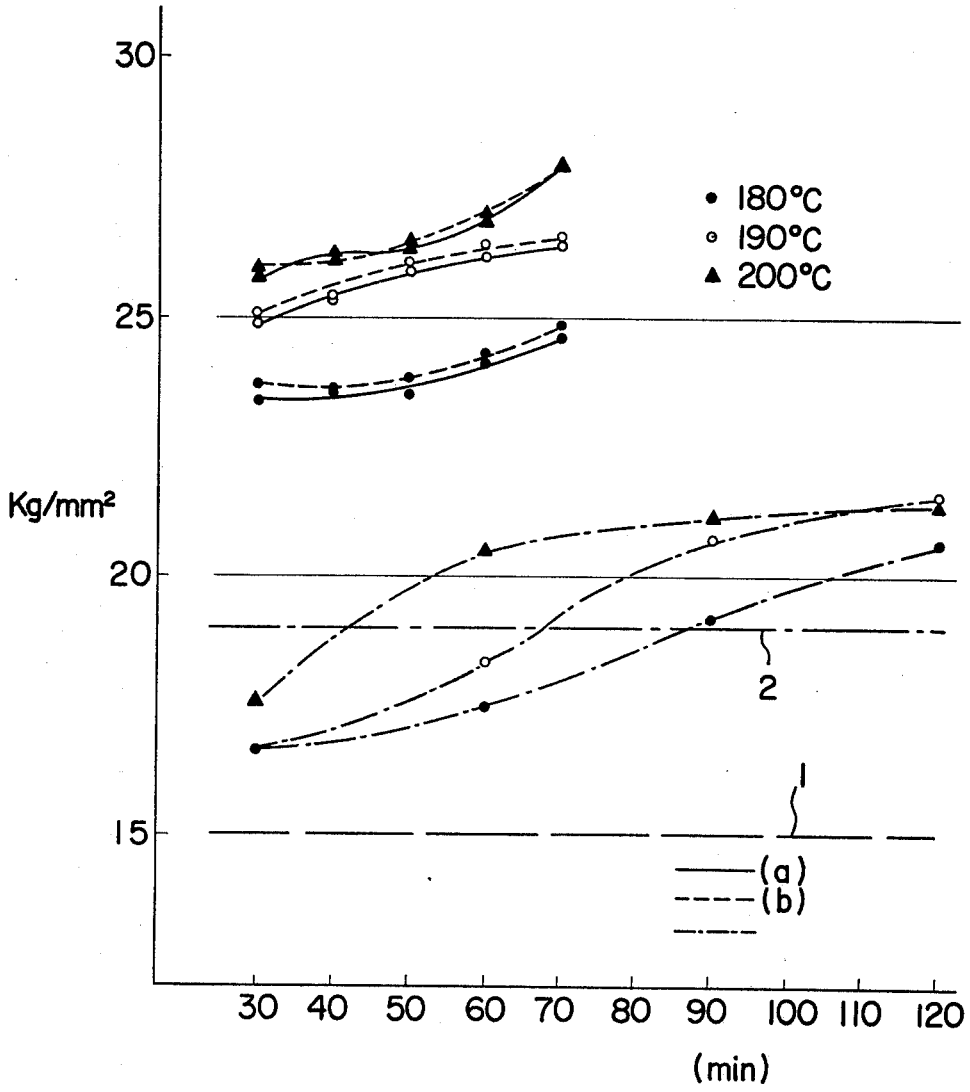
Figure 6:
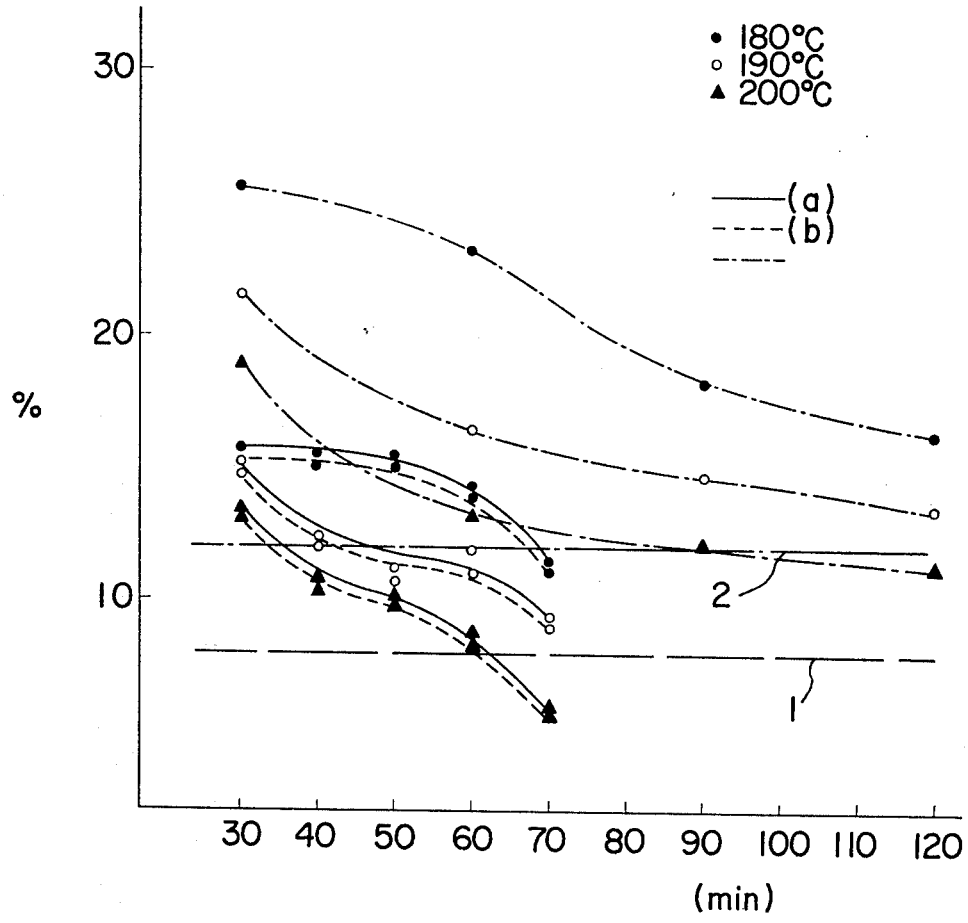

Further, the relationships of the aging time to the ultimate tensile strength and the elongation in the alloys *a, b* and A.A.6063 are such as shown in FIGS. 5 and 6, respectively.

In FIGS. 3 to 6, reference numerals 1 and 2 designate the JIS (Japanese Industrial Standards) level and the A.A. standard level, respectively.

The effects of the alloys *a* and *b* of this invention were ascertained as described above and, at the same time, the close contact property of the coated films on the alloys was examined in boiling water and, as a result of this examination, found to be very excellent.

EXAMPLE 2

As in the Example 1, two kinds of shapes formed of an alloy on the market and the alloy (a) of this invention, both employed in the Example 1, were heated at 190° C for 30 minutes to effect printing and hardening of coated films and, also, age hardening. Sliding doors such as shown in FIGS. 7, 8 and 9 were actually formed with the above two kinds of aluminum alloy shapes and each of the sliding doors was put to a pressure resistant test by a wind tunnel to examine its actual pressure resistance.

Figure 7:
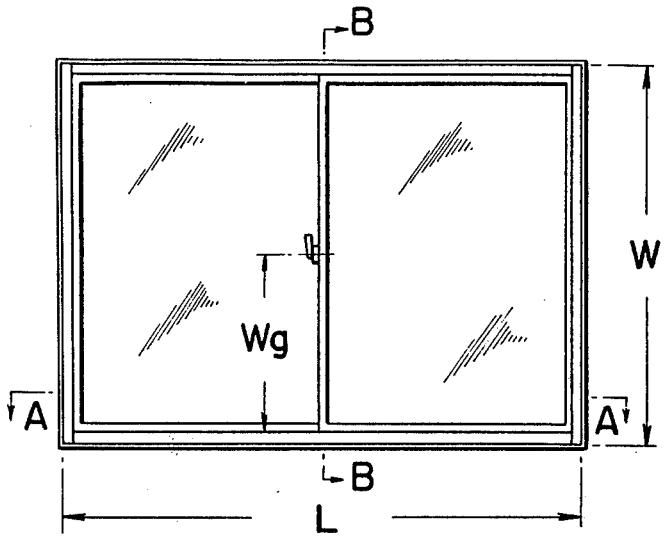
FIG. 7 is a front view of a sliding door put to a wind tunnel test.
Figure 8:
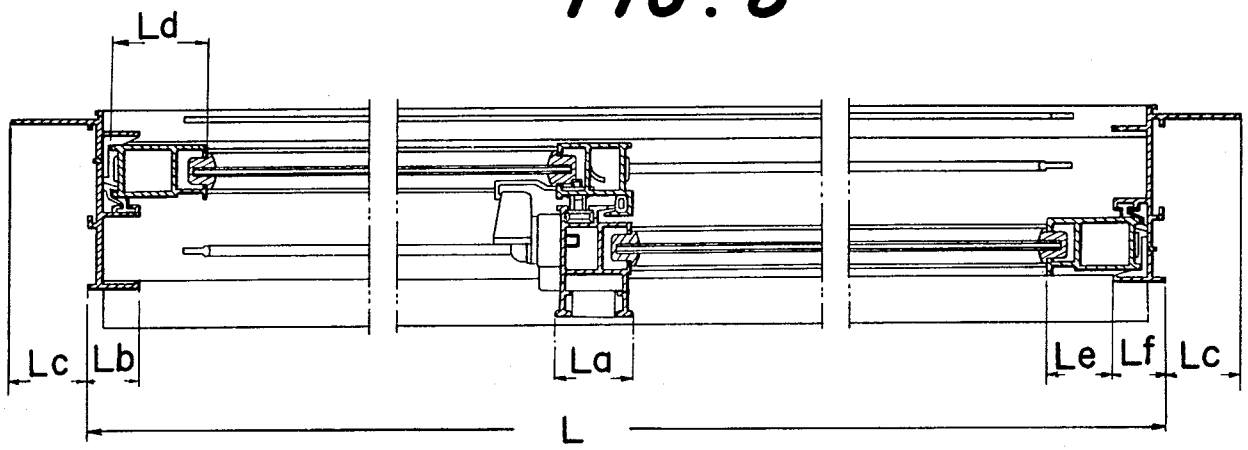
FIG. 8 is a cross-sectional view taken on the line A—A in FIG. 7.
Figure 9:
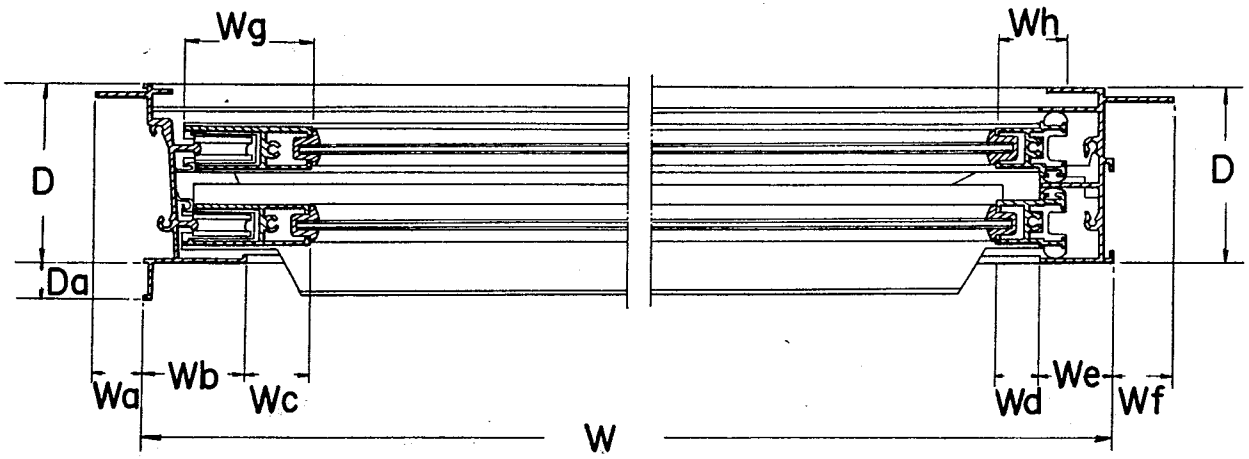
FIG. 9 is a cross-sectional view taken on the line B—B in FIG. 7.

A front view of each sliding door put to the test is shown in FIG. 7 and its cross-sectional view taken on the lines A—A and B—B in FIG. 7 are shown in FIGS. 8 and 9, respectively. The sizes of those parts of the sliding indicated by reference characters in FIGS. 7 to 9 are as follows:

W = 1,360 mm
Wa = 18 mm
Wb = 35 mm
Wc = 21.5 mm
Wd = 14 mm
We = 25 mm
Wf = 20 mm
Wg = 44 mm
Wh = 23 mm
Wi = 643.5 mm
L = 1,697 mm
La = 25 mm
Lb = 17 mm
Lc = 26 mm
Ld = 32 mm
Le = 22 mm
Lf = 17 mm
D = 60 mm

In the wind tunnel test, air was blown against each sliding door from the outside thereof or sucked on the outside thereof at a pressure of 50 kg/m² to 120 kg/m² and deflection at the position of Wg in FIG. 7 was measured.

The mode of blowing or suction of air was such that pressure of air blown against the sliding door from the outside thereof was taken as positive and that pressure of air sucked on the outside of the sliding door was taken as negative. The positive and negative pressures are indicated by circles and crosses, respectively, in FIG. 10.

Figure 10:
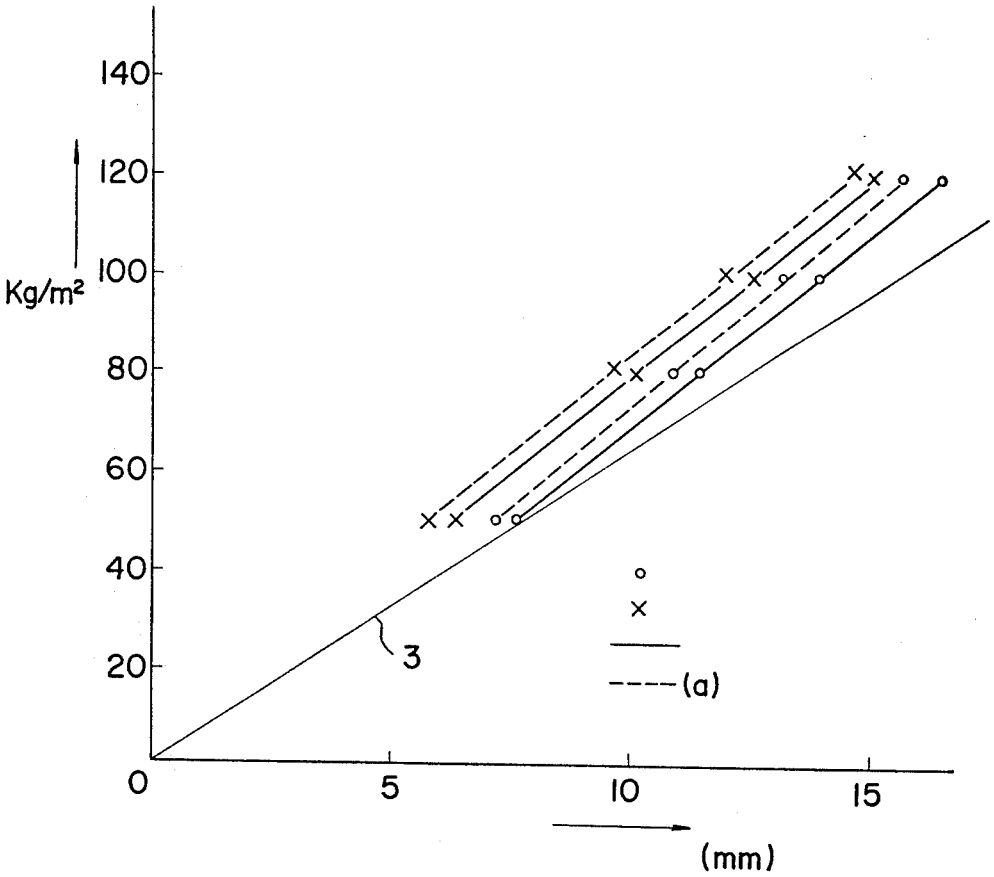
FIG. 10 is a graph showing the results of the wind tunnel test of the sliding door shown in FIGS. 7 to 9.

Considering that sliding doors above the solid line 3 in FIG. 10 are accepted ones, the sashes formed of the alloy shapes of this invention are all excellent.

As has been described in detail in the foregoing, in the aluminum alloy shapes of this invention, aging properly proceeds at a temperature below 200° C for 20 to 50 minutes and sufficient mechanical strength can be obtained. Accordingly, even if a water soluble thermal setting type paint is employed, printing and hardening of the coated film and age hardening can be achieved simultaneously. This permits simplification of processes for the manufacture of aluminum alloy shapes and remarked reduction of energy consumed therefor. Moreover, as is apparent from a comparison of the aging conditions of this invention with that of the conventional age hardening aluminum alloy shapes, the aging temperature is low and the aging time is appreciably short. This also accomplishes an economy of energy.

It will be apparent that many modifications and variations may be effected without departing from the scope of the novel concepts of this invention.

We claim as our invention:

1. An aluminum alloy shape formed of an aluminum alloy consisting essentially of 0.65 to 0.75% by weight of magnesium, 0.5 to 0.6% by weight of silicon, 0.15 to 0.25% by weight of iron, less than 0.05% by weight of impurities selected from the group consisting of zinc, manganese, chromium, copper, and titanium, and the balance aluminum, said aluminum shape having thereon an anodized oxide film and being coated over its surface with a water-soluble paint which has been hardened at a temperature below 200° C., and having been subjected to an aging treatment at a temperature below 200° C. for 20 to 50 minutes to deposit $Mg_2Si$ to obtain a 0.2% proof stress larger than 11 kg/mm², an ultimate tensile strength larger than 20 kg/mm² and an elongation more than 8%.

2. An aluminum alloy shape formed of an aluminum alloy consisting essentially of 0.47 to 0.57% by weight of magnesium, 0.75 to 0.85% by weight of silicon, 0.15 to 0.25% by weight of iron, less than 0.05% by weight of impurities selected from the group consisting of zinc, manganese, chromium, copper and titanium, and the balance aluminum, said aluminum shape having thereon an anodized oxide film and being coated over its surface with a water-soluble paint which has been hardened at a temperature below 200° C., and having been subjected to an aging treatment at a temperature below 200° C. for 20 to 50 minutes to deposit $Mg_2Si$ to obtain a 0.2% proof stress larger than 11 kg/mm², an ultimate tensile strength larger than 20 kg/mm² and an elongation more than 8%.

* * * * *